US007595758B2

(12) United States Patent
Wong et al.

(10) Patent No.: US 7,595,758 B2
(45) Date of Patent: Sep. 29, 2009

(54) COMPACT DTV RECEIVING ANTENNA

(75) Inventors: Kin-Lu Wong, Kao-Hsiung (TW); Wei-Yu Li, I-Lan (TW); Saou-Wen Su, Taipei (TW)

(73) Assignees: Lite-On Technology Corp., Taipei (TW); National Sun Yat-Sen University, Kao-Hsiung (TW)

( * ) Notice: Subject to any disclaimer, the term of this patent is extended or adjusted under 35 U.S.C. 154(b) by 0 days.

(21) Appl. No.: 11/560,821

(22) Filed: Nov. 16, 2006

(65) Prior Publication Data

US 2008/0024367 A1 Jan. 31, 2008

(30) Foreign Application Priority Data

Jul. 28, 2006 (TW) ..... 95127839 A

(51) Int. Cl.
*H01Q 1/24* (2006.01)

(52) U.S. Cl. ..... 343/702

(58) Field of Classification Search ..... 343/700 MS, 343/702, 880–882, 793, 803, 805, 806
See application file for complete search history.

(56) References Cited

U.S. PATENT DOCUMENTS 6,034,636 A * 3/2000 Saitoh ..... 343/700 MS
6,255,995 B1 * 7/2001 Asano et al. ..... 343/700 MS
6,344,826 B1 * 2/2002 Matsuura et al. ..... 343/702
6,621,464 B1 * 9/2003 Fang et al. ..... 343/795
2002/0101382 A1 * 8/2002 Konishi et al. ..... 343/702
2003/0063036 A1 * 4/2003 Sato et al. ..... 343/702
2005/0156787 A1 * 7/2005 Myoung et al. ..... 343/700 MS
2006/0170597 A1 * 8/2006 Kurashima et al. .... 343/700 MS

FOREIGN PATENT DOCUMENTS

| | | |
|---|---|---|
| TW | M269583 | 7/2005 |
| TW | M270510 | 7/2005 |
| TW | D110366 | 4/2006 |
| TW | I255589 | 5/2006 |
| TW | I257194 | 6/2006 |

* cited by examiner

*Primary Examiner*—Trinh V Dinh
*Assistant Examiner*—Dieu Hien T Duong
(74) *Attorney, Agent, or Firm*—Kile Goekjian Reed & McManus PLLC

(57) ABSTRACT

A digital television receiving antenna includes a first radiating element and a second radiating element electrically connected to the first radiating element. The second radiating element is foldable, and includes a wide radiating metal plate, and a narrow radiating metal strip, wherein one end of the narrow radiating metal strip is a feeding point insulated from the first radiating element with a predefined distance, and the other end of the narrow radiating metal strip is electrically connected to the wide radiating metal plate.

21 Claims, 9 Drawing Sheets

COMPACT DTV RECEIVING ANTENNA

BACKGROUND OF THE INVENTION

1. Field of the Invention

The present invention relates to a digital-television receiving antenna, and more particularly, to a compact digital-television receiving antenna.

2. Description of the Prior Art

With rapid development of wireless communication technology, wireless communication applications are more and more popular. Performances of the wireless communication applications are highly related to volumes and functions of antennas thereof. Since analog signals transmitted by analog communication systems are easily interfered during wireless transmission, digital communication systems are being substituted for the analog communication systems. For example, a digital television (DTV) system can perform digital signal processing to discard noise generated during broadcasting, so that the DTV system can prevent snowflakes, ghost images, and increase image quality in comparison with an analog TV system, which follows NTSC (National Television Standard Committee) standard. In addition, digital signals can be compressed to increase the efficiency of frequency utilization. Now, the DTV system has been developed in three main standards, DVB (Digital Video Broadcasting) by European Broadcast Union (EBU), ATSC (Advanced Television Systems Committee) by US, and ISDB (Integrated Services Digital Broadcasting) by Japan.

Plug-and-play (P&P) devices, such as USB (universal serial bus) devices, combining DTV tuners are greatly demanded. Using such devices, DTV signals can be received, demodulated, and transmitted to a desktop or notebook through a USB interface, so that a user can enjoy DTV programs through the desktop or notebook anytime and anywhere. In the prior art, most P&P DTV receivers are connected to external receiving antennas through external wires, which is inconvenient for using. TW patent No. M270,510 discloses a DTV receiving antenna, which functions with a large length and is inconvenient for using. TW patent No. M269,583 discloses another DTV receiving antenna, which is formed as a helix structure and requires high production cost.

SUMMARY OF THE INVENTION

It is therefore a primary objective of the claimed invention to provide a compact digital television receiving antenna.

According to the claimed invention, a digital television receiving antenna comprises a first radiating element and a second radiating element electronically connected to the first radiating element. The second radiating element is foldable, and comprises a wide radiating metal plate, and a narrow radiating metal strip, wherein one end of the narrow radiating metal strip is a feeding point insulated from the first radiating element with a predefined distance, and the other end of the narrow radiating metal strip is electronically connected to the wide radiating metal plate.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
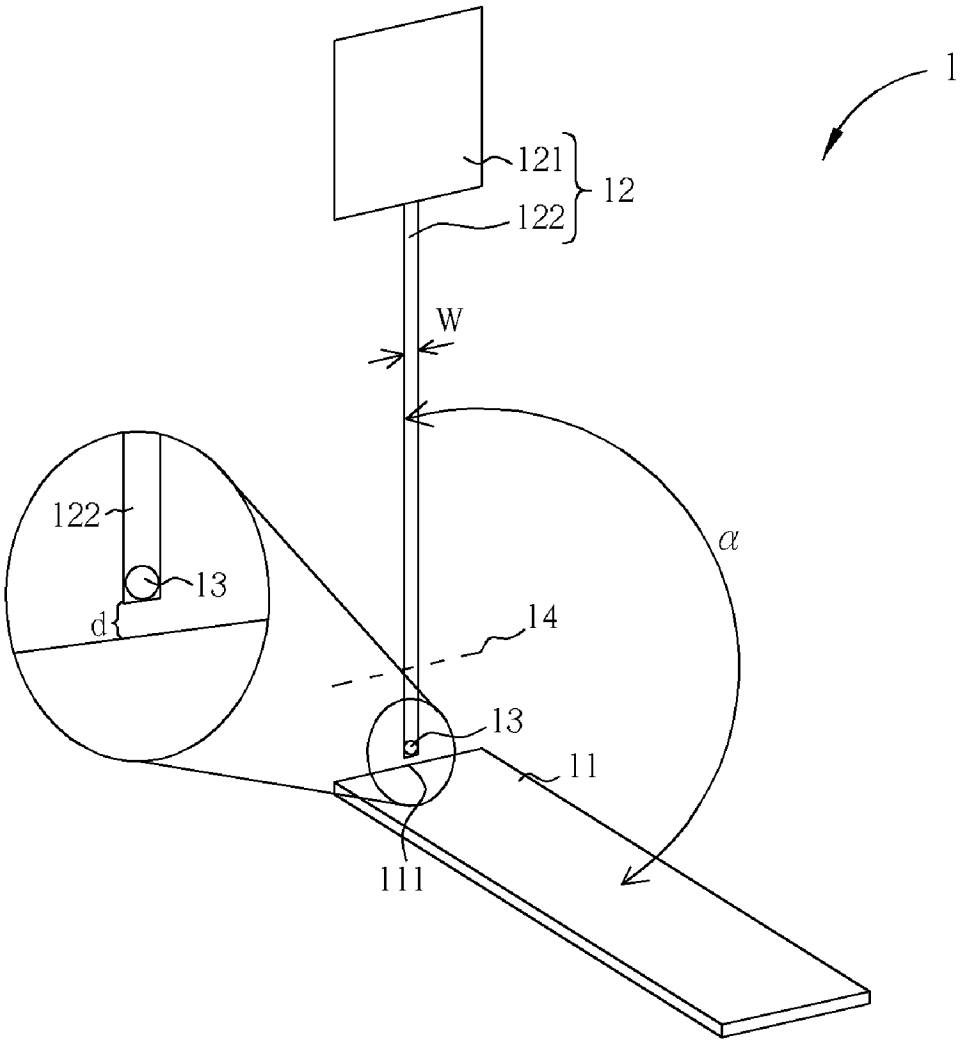
FIG. 1 illustrates a schematic diagram of an antenna in accordance with an embodiment of the present invention.

Please refer to FIG. 1, which illustrates a schematic diagram of an antenna 1 in accordance with an embodiment of the present invention. The antenna 1 includes a first radiating element 11 and a second radiating element 12. The first radiating element 11 is made of metal with a rectangular shape, and utilized for forming a system ground of a plug and play (ex. USB) device. A flare angle is formed between the second radiating element 12 and the first radiating element 11. The second radiating element 12 includes a wide radiating metal plate 121 and a bar-shaped narrow radiating metal strip 122. The width of the narrow radiating metal strip 122 is smaller than 3 mm. One end of the narrow radiating metal strip 122 is a feeding point 13 of the antenna 1, while the other end is electronically connected to the wide radiating metal plate 121. The feeding point 13 and an edge 111 of the first radiating element 11 are separated with a predefined distance d smaller than 5 mm. The flare angle is in a range of 45° to 180°. In the present invention, the bar-shaped narrow radiating metal strip 122 is used for increasing the inductance of the antenna 1. In this case, the current will reach its maximum value more rapidly than the original path does. Thus, the resonance frequency of the antenna 1 can be decreased so as to compact the size of the antenna 1, and the height of the antenna 1 after opening up can be decreased. Moreover, the wide radiating metal plate 121 is used for making the excited surface current more uniform, which further decreases the resonance frequency and improves the impedance bandwidth of the antenna.

Figure 2:
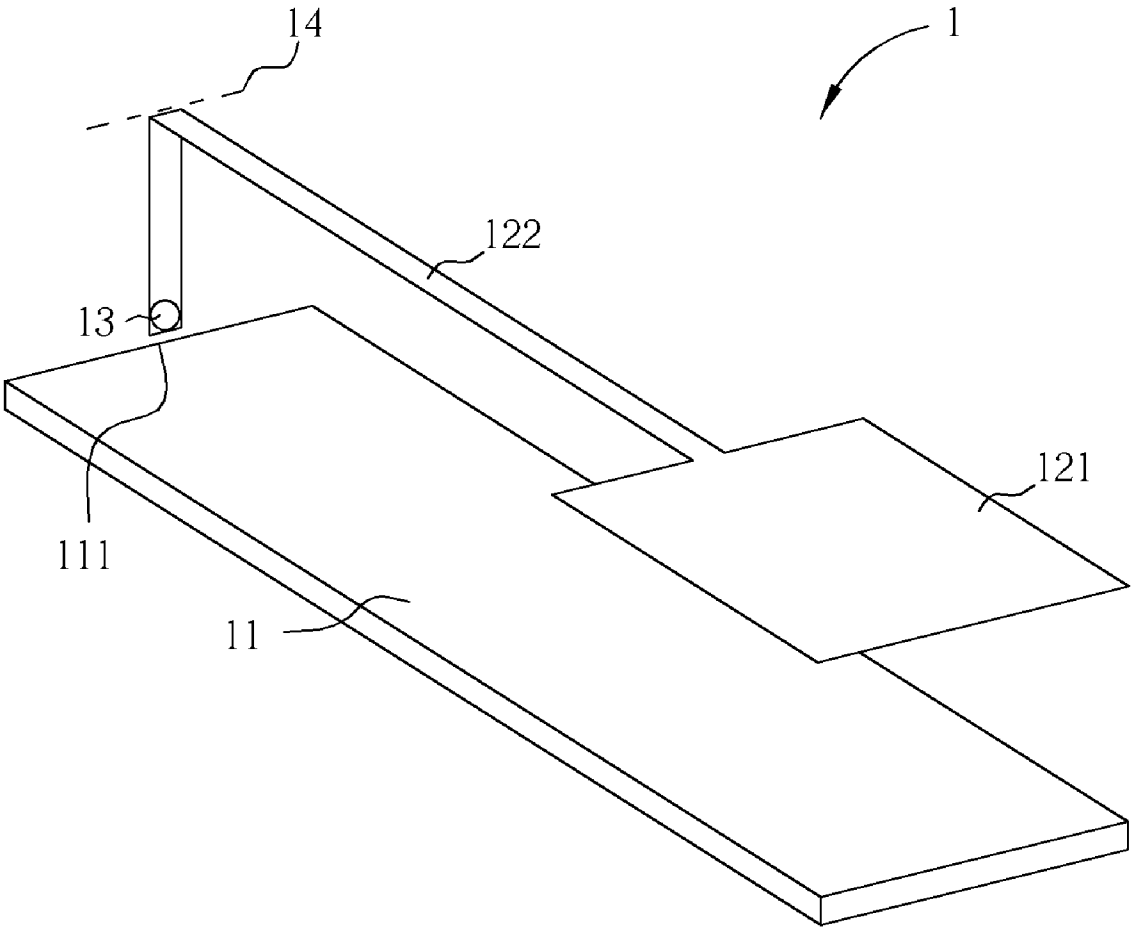
FIG. 2 illustrates a schematic diagram of the antenna shown in FIG. 1 in a non-operating state.

FIG. 2 illustrates a schematic diagram of the antenna 1 in a non-operating state, in which the flare angle is zero. In the present invention, the first radiating element 11 and the second radiating element 12 are simply film-shaped structures. Therefore, when the antenna 1 is applied as a USB DTV receiving antenna, an aesthetic appearance of the antenna 1 can be easily designed in an operating state. Also, in the non-operating state, the antenna 1 can be easily folded along a folding line 14 shown in FIG. 1 and FIG. 2.

Figure 3:
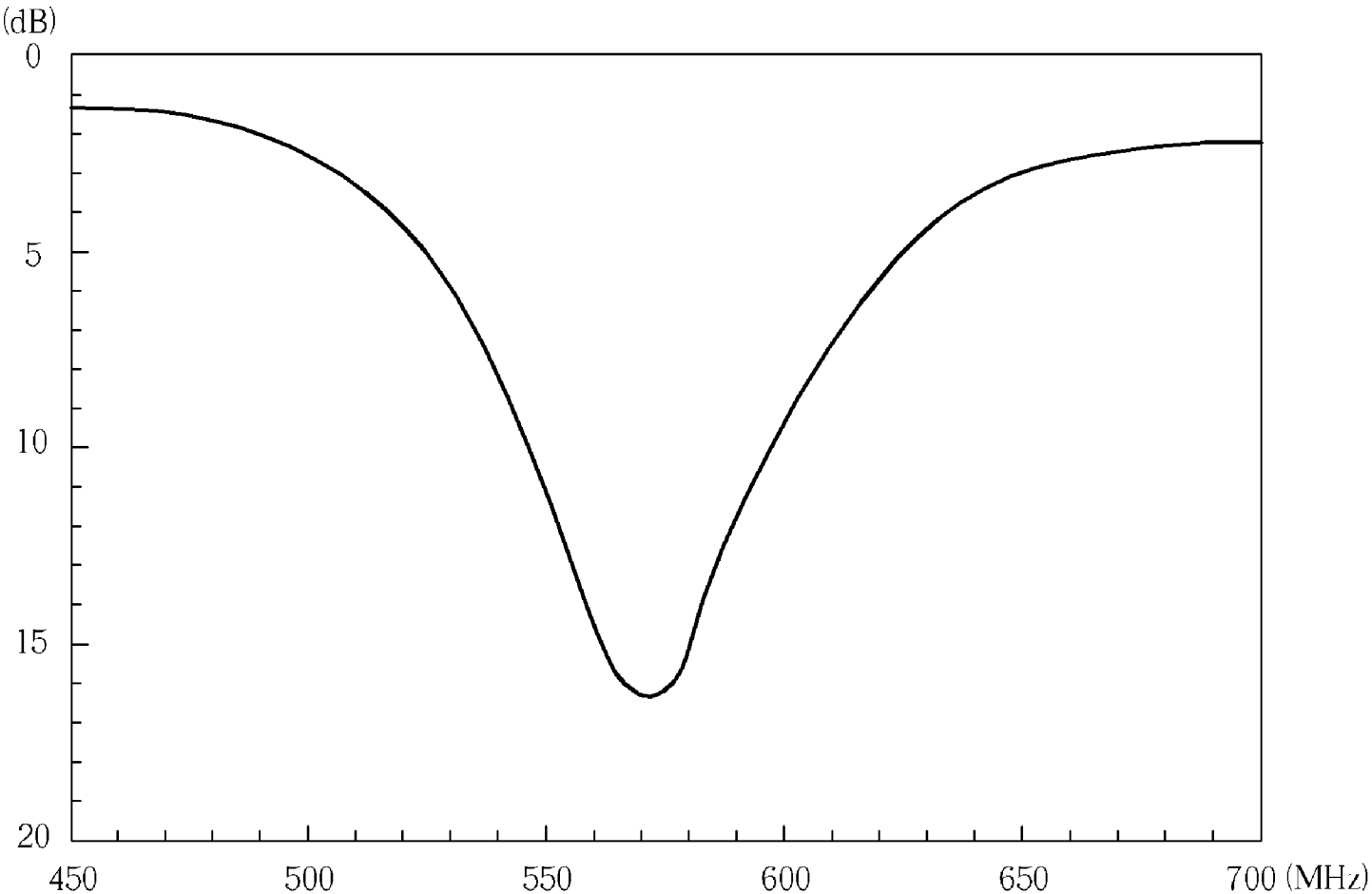
FIG. 3 illustrates a schematic diagram of measured return loss of the antenna shown in FIG. 1.

FIG. 3 illustrates a schematic diagram of measured return loss of the antenna 1. To perform the experiment, the first radiating element 11 is formed by a rectangular metal plate, 90 mm long and 20 mm wide. In the second radiating element 12, the wide radiating metal plate 121 is 25 mm long and 20 mm wide, while the narrow radiating metal strip 122 is 75 mm long, 1 mm wide and between the feeding point 13 and the center of the wide radiating metal plate 121. The distance d between the feeding point 13 and the edge 111 of the first radiating element 11 is 2 mm. The flare angle between the first radiating element 11 and the second radiating element 12 is 90°. The first radiating element 11 and the second radiating element 12 are formed on a dielectric substrate (not shown in FIG. 1 and FIG. 2) with a 0.8-mm thickness by printing or etching. In FIG. 3, y-axis represents the values of measured return loss, and x-axis represents the operating frequencies. As shown in FIG. 3, the return loss values of the present invention antenna are greater than 5 dB between the operating frequencies of 520 and 630 MHz, which meets the requirements for DTV signal reception. In this case, the total length of the first radiating element 11 and the second radiating element 12 is equal to 0.36 times the wavelength of the center frequency 570 MHz. However, in the prior art, the total length of the first radiating element and the second radiating element must be equal to 0.5 times the wavelength of the center frequency 570 MHz. Therefore, the present invention can decrease by about 70 mm of the total length of the antenna. Preferably, the distance d is smaller than 5 mm, and the flare angle is greater than 45° in the operating state.

Figure 4:
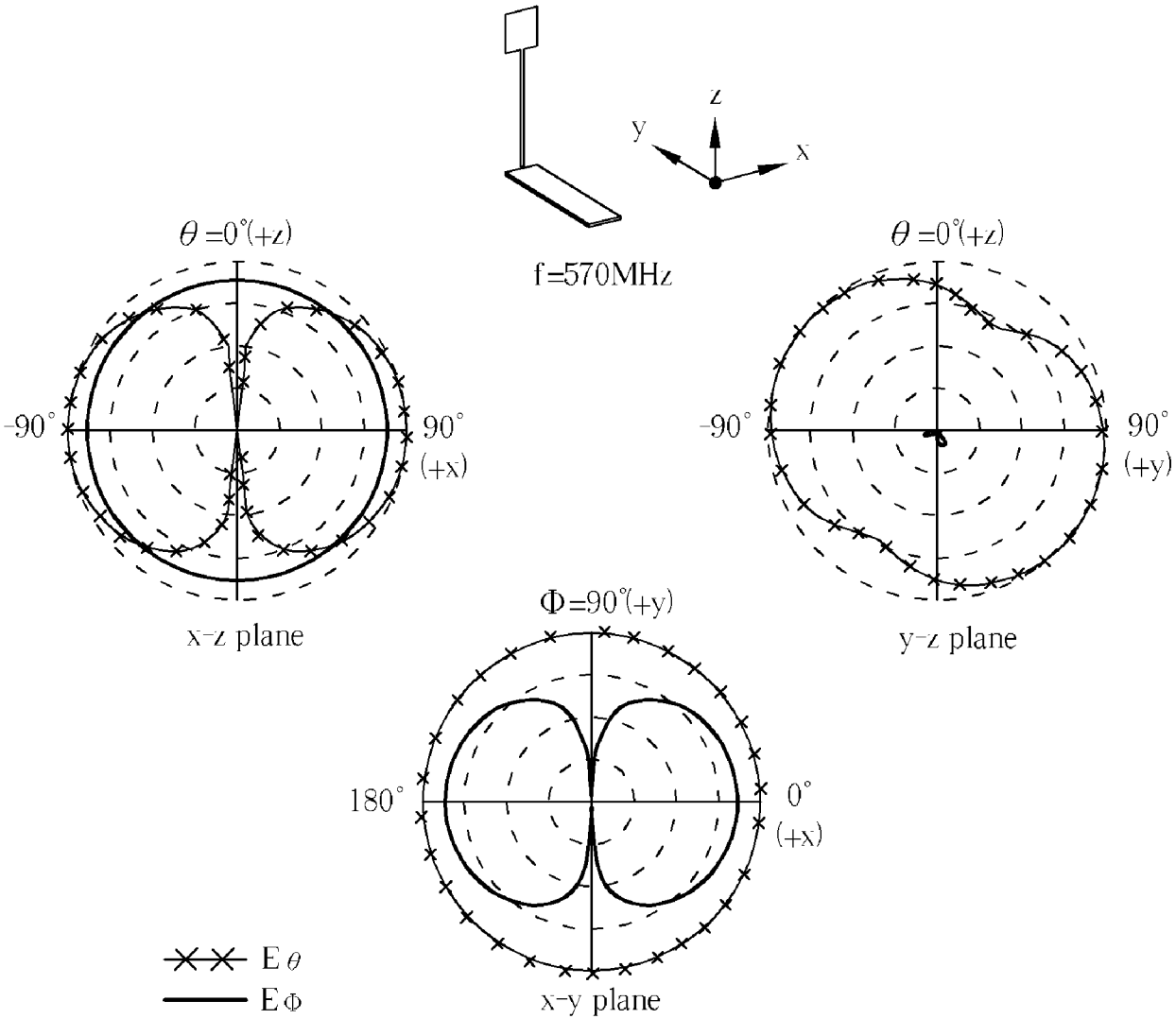
FIG. 4 illustrates a schematic diagram of a radiation pattern of the antenna shown in FIG. 1 at 570 MHz.

FIG. 4 illustrates a schematic diagram of a radiation pattern of the antenna 1 at 570 MHz. As shown in FIG. 4, the radiation pattern of x-y plane is approximately omni-directional, which meets the requirements for DTV signal reception.

Figure 5:
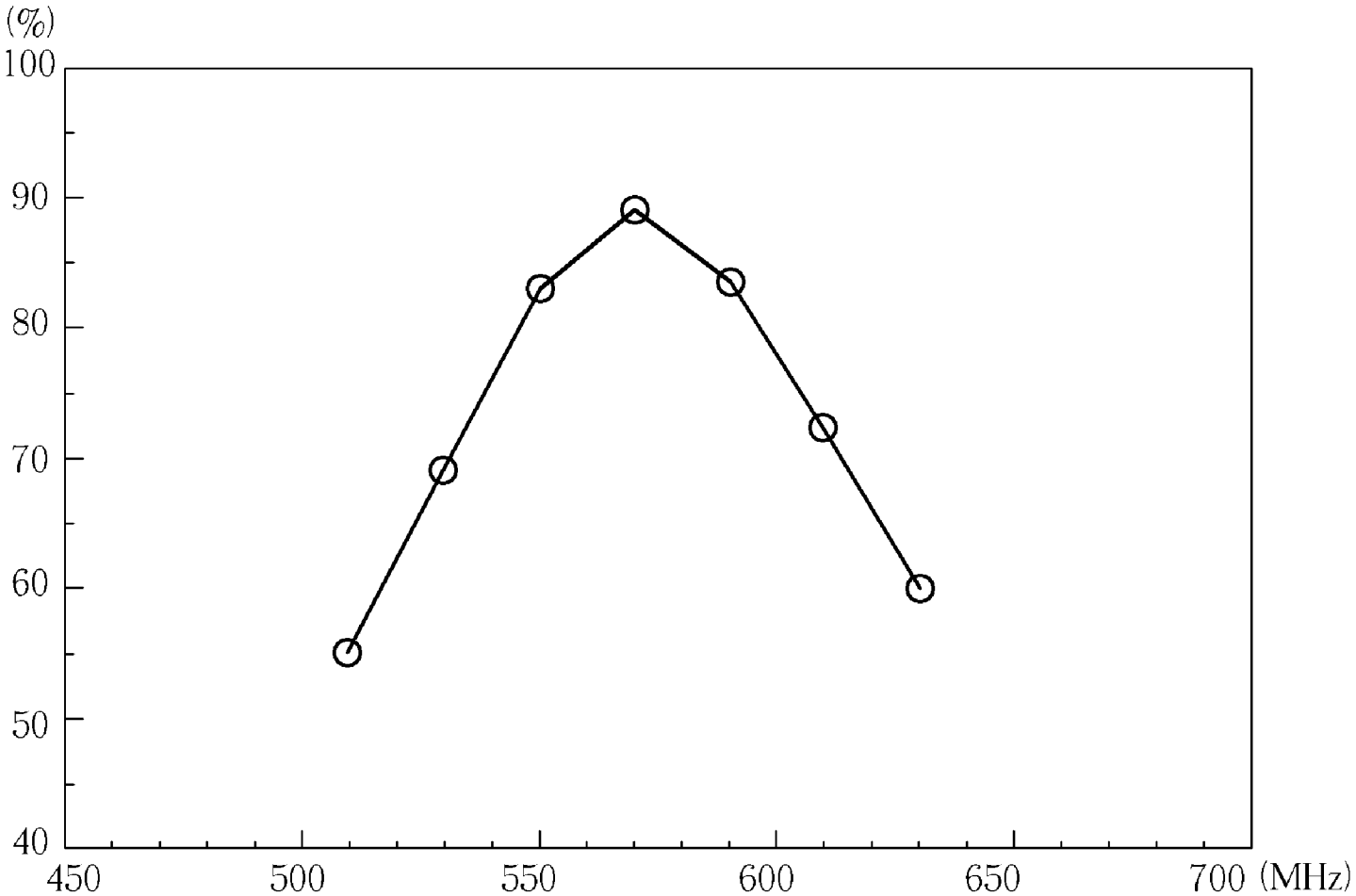
FIG. 5 illustrates a schematic diagram of radiation efficiencies of the antenna shown in FIG. 1.

FIG. 5 illustrates a schematic diagram of radiation efficiencies of the antenna 1. In FIG. 5, y-axis represents the radiation efficiencies, and x-axis represents the operating frequencies of the antenna 1. The radiation efficiencies of the antenna 1 operating at frequencies between 500 and 650 MHz are higher than 50%, which meets the requirements for DTV signal reception.

Figure 6:
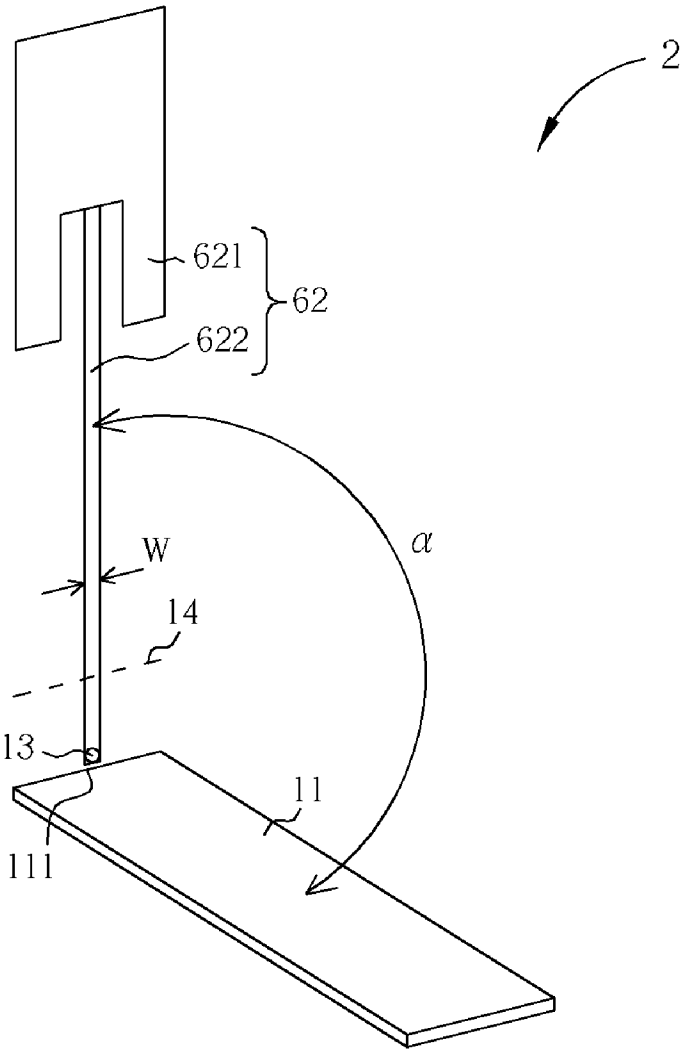
FIG. 6 illustrates a schematic diagram of an antenna in accordance with an embodiment of the present invention.

FIG. 6 illustrates a schematic diagram of an antenna 2 in accordance with an embodiment of the present invention. The structure of the antenna 2 is similar to that of the antenna 1, except that the shape of a wide radiating metal plate 621 in the antenna 2 is different from that of the wide radiating metal plate 121 in the antenna 1. A narrow radiating metal strip 622 of the antenna 2 can also increase the inductance of the antenna, so that the resonance frequency of the antenna 2 can be decreased to compact the size of the antenna 2. In addition, similar to the antenna 1, the wide radiating metal plate 621 in the antenna 2 can make the excited surface current more uniform, which further decreases the resonance frequency and improves the impedance bandwidth of the antenna.

Figure 7:
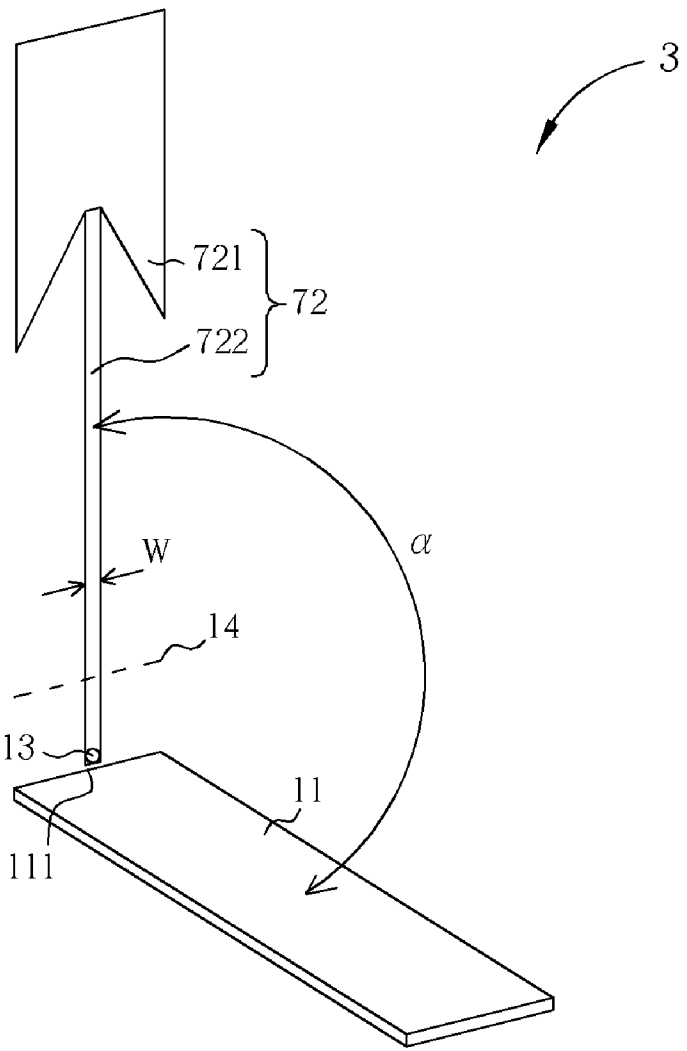
FIG. 7 illustrates a schematic diagram of an antenna in accordance with an embodiment of the present invention.

FIG. 7 illustrates a schematic diagram of an antenna 3 in accordance with an embodiment of the present invention. The structure of the antenna 3 is similar to that of the antenna 1, except that the shape of a wide radiating metal plate 721 in the antenna 3 is different from that of the wide radiating metal plate 121 in the antenna 1, and a second radiating element 72 is formed by segmenting a single metal plate. A narrow radiating metal strip 722 of the antenna 3 can also increase inductance of the antenna, so that the resonance frequency of the antenna 3 can be decreased to compact the size of the antenna 3. In addition, similar to the antenna 1, the wide radiating metal plate 721 in the antenna 3 can make the excited surface current more uniform, which further decreases the resonance frequency and improves the impedance bandwidth of the antenna.

Figure 8:
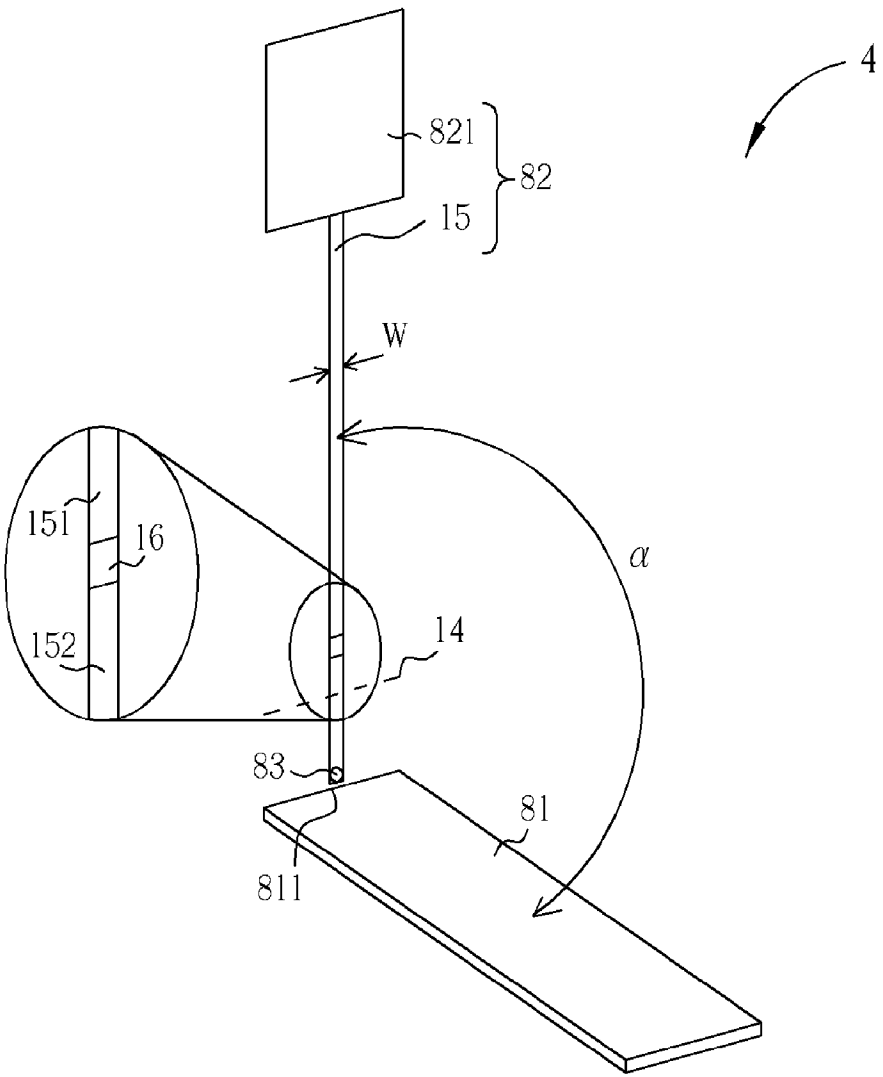
FIG. 8 illustrates a schematic diagram of an antenna in accordance with an embodiment of the present invention.

FIG. 8 illustrates a schematic diagram of the antenna 4 in accordance with an embodiment of the present invention. The antenna 4 includes a first radiating element 81 and a second radiating element 82. The first radiating element 81 is formed by a metal plate with a rectangular shape, and is taken as a ground of a plug and play (ex. USB) device. A flare angle is formed between the second radiating element 82 and the first radiating element 11. The second radiating element 82 includes a wide radiating metal plate 821 and a third radiating element 15. The third radiating element 15 is composed of a first narrow radiating metal strip 151, a second narrow radiating metal strip 152, and an inductance element 16. Widths of the first narrow radiating metal strip 151 and the second narrow radiating metal strip 152 are less than 3 mm. The inductance element 16 is between the first narrow radiating metal strip 151 and the second narrow radiating metal strip 152. One end of the radiating element 15 is electrically connected to the wide radiating metal plate 821, while the other end is a feeding point 83 of the antenna 4. The feeding point 83 and an edge 811 of the first radiating element 81 are separated with a distance d less than 5 mm. The flare angle is in a range of 45° to 180°. The inductance element 16 is a chip inductor. In the present invention, the narrow radiating metal strip 151, the second narrow radiating metal strip 152, and the inductance element 16 are used for increasing the inductance of the antenna 4, so that the resonance frequency of the antenna 4 can be decreased to compact the size of the antenna 1, and the height of the antenna 4 after opening up can be decreased. Moreover, the wide radiating metal plate 821 is used for making the excited surface current more uniform, which further decreases the resonance frequency and improves the impedance bandwidth of the antenna.

Figure 9:
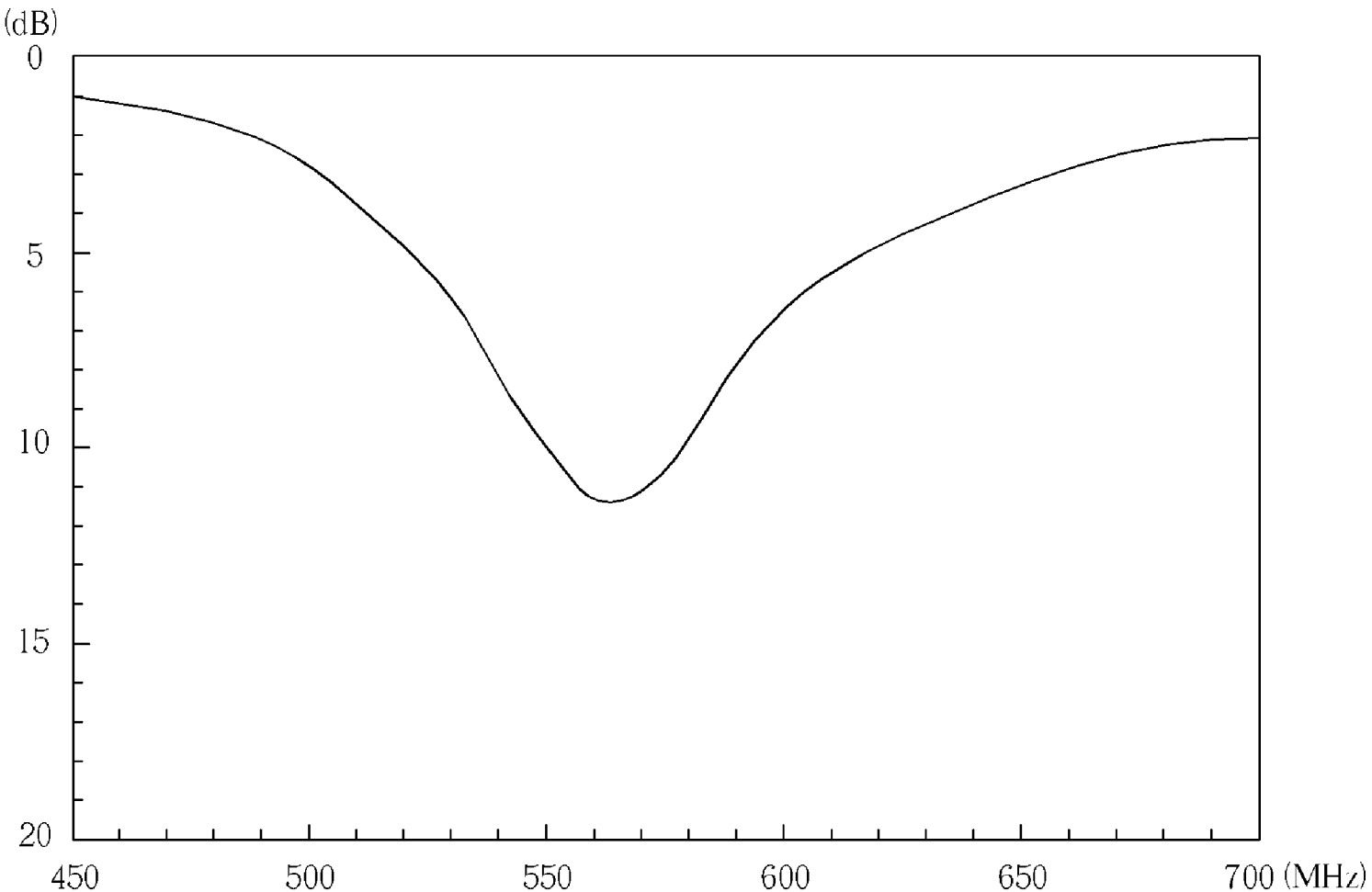
FIG. 9 illustrates a schematic diagram of measured return loss of the antenna shown in FIG. 8.

FIG. 9 illustrates a schematic diagram of measured return loss of the antenna 4. To perform the experiment, the first radiating element 81 is formed by a rectangular metal plate, 90 mm long and 20 mm wide. In the second radiating element 82, the wide radiating metal plate 821 is 25 mm long and 20 mm wide. In the radiating element 15, the first narrow radiating metal strip 151 is 53 mm long and 1 mm wide, the second narrow radiating metal strip 152 is 10 mm long and 1 mm wide, and the inductance element 16 is a 2 mm-long and 1.2 mm-wide chip inductor having an inductance of 15 nH. The inductance element 16 is between the first narrow radiating metal strip 151 and the second narrow radiating metal strip 152. The distance d between the feeding point 83 and the edge 811 of the first radiating element 81 is 2 mm. The flare angle between the first radiating element 81 and the second radiating element 82 is 90°. The first radiating element 81, the first narrow radiating metal strip 151, and the second narrow radiating metal strip 152 are formed on a dielectric substrate with a 0.8-mm thickness by printing or etching. In FIG. 9, y-axis represents the values of return loss, and x-axis represents the operating frequencies. As shown in FIG. 9, the return-loss values of the antenna 4 are greater than 5 dB for frequencies between 530 and 620 MHz, which meets the requirements of DTV signal reception. Preferably, the distance d is smaller than 5 mm, and the flare angle is greater than 45° in the operating state.

Certainly, other than the antenna 1 and antenna 4, the present invention can provide antennas with different shapes from those of wide radiating metal plates mentioned above. Such as trapezoid, polygonal, elliptic, or circular shapes also are within the scope of the present invention. In summary, the present invention can increase the inductance of the antenna by using the bar-shaped narrow radiating metal strip or using the narrow radiating metal strip and the chip inductor, so as to compact the size of the antenna, and decrease the height of the antenna after opening up. Therefore, the present invention antenna is suitable for P&P DTV receiving antenna, and has a simple structure, so that production cost can be decreased.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A digital television receiving antenna, comprising:

a first radiating element; and a second radiating element, the second radiating element comprising:

a wide radiating metal plate having a wide width; and a narrow radiating metal strip having a narrow width and a length, the narrow width of the narrow radiating metal strip is narrower the wide width of the wide radiating metal plate, wherein one end of the length of the narrow radiating metal strip is a feeding point insulated from the first radiating element with a predefined distance less than 5 mm, and the other end of the narrow radiating metal strip is electrically connected to the wide radiating metal plate, a portion of the narrow radiating metal strip rotatable through a 45° to 180° flare angle relative to the first radiating element; and wherein the narrow width of the narrow radiating metal strip is smaller than 3 mm; and wherein the first radiating element is a ground.

2. The digital television receiving antenna of claim 1, wherein the first radiating element is made of metal.

3. The digital television receiving antenna of claim 1, wherein the first radiating element is formed on a dielectric substrate by printing or etching.

4. The digital television receiving antenna of claim 1, wherein the second radiating element is formed on a dielectric substrate by printing or etching.

5. The digital television receiving antenna of claim 1, wherein the second radiating element is formed by segmenting a metal plate.

6. The digital television receiving antenna of claim 1, wherein the narrow radiating metal strip further comprises an inductance element, and the inductance element is not connected to the feeding point and the wide radiating metal plate.

7. The digital television receiving antenna of claim 1, wherein the wide radiating metal plate is rectangular.

8. The digital television receiving antenna of claim 7, wherein the wide radiating metal plate comprises a sleeve-shaped side, and the narrow radiating metal strip is electrically connected to the sleeve-shaped side.

9. The digital television receiving antenna of claim 8, wherein the sleeve-shaped side is triangular.

10. The digital television receiving antenna of claim 1, wherein the wide radiating metal plate is trapezoid.

11. The digital television receiving antenna of claim 1, wherein the wide radiating metal plate is polygonal.

12. The digital television receiving antenna of claim 1, wherein the wide radiating metal plate is elliptic.

13. The digital television receiving antenna of claim 1, wherein the wide radiating metal plate is circular.

14. The digital television receiving antenna of claim 1, wherein the first radiating element is a ground of a plug-and-play device.

15. The digital television receiving antenna of claim 1, wherein a total length of the first radiating element and the second radiating element is less than one half a wavelength of a center frequency to be received by the digital television receiving antenna.

16. The digital television receiving antenna of claim 1, wherein the width of the narrow radiating metal strip is substantially one millimeter, and a total length of the first radiating element and the second radiating element is substantially equal to 0.36 times a wavelength of a center frequency to be received by the digital television receiving antenna.

17. The digital television receiving antenna of claim 1, wherein the second radiating element is for folding relative to the first radiating element such that a first flare angle is formed during an operating state of the digital television receiving antenna, and for folding to form a second flare angle being different than the first flare angle during a non-operating state of the digital television receiving antenna.

18. The digital television receiving antenna of claim 17, wherein the second radiating element is for folding along a folding line at a portion of the narrow radiating element which contains the feeding point.

19. The digital television receiving antenna of claim 17, wherein the first flare angle formed during the operating state is 45° to 180°, and the second flare angle formed during the non-operating state is 0°.

20. The digital television receiving antenna of claim 17, wherein the first flare angle formed during the operating state is 90°, and the second flare angle formed during the non-operating state is 0°.

21. The digital television receiving antenna of claim 17, wherein the digital television receiving antenna is applied on a universal serial bus (USB) digital television (DTV) receiver.

* * * * *